US005529250A

United States Patent [19]

Pallmann

[11] Patent Number: 5,529,250

[45] Date of Patent: Jun. 25, 1996

[54] FEEDING DEVICE FOR GAS SWEPT SIZED REDUCTION MACHINES

[75] Inventor: Wilhelm Pallmann, Zweibrucken, Germany

[73] Assignee: Pallmann Maschinenfabrik GmbH & Co. KG, Zweibrucken, Germany

[21] Appl. No.: 241,165

[22] Filed: May 10, 1994

[30] Foreign Application Priority Data

May 15, 1993 [DE] Germany ..... 43 16 350.5

[51] Int. Cl.[6] ..... B02C 13/286; B02C 13/288; B02C 23/02; B02C 23/24

[52] U.S. Cl. ..... 241/57; 241/59; 241/62; 241/69; 241/81; 241/186.3; 241/224

[58] Field of Search ..... 241/62, 69, 79.1, 241/81, 186.2, 224, 186.3, 222, 57, 285.1, 100, DIG. 30, 59; 209/149, 154, 502

[56] References Cited

U.S. PATENT DOCUMENTS

| | | | |
|---|---|---|---|
| 1,088,438 | 2/1914 | Moore | 241/81 X |
| 1,272,311 | 7/1918 | Plaisted | 241/62 X |
| 1,306,775 | 6/1919 | Roberts | 241/62 X |
| 1,418,866 | 6/1922 | Dennig | 241/62 X |
| 1,509,089 | 9/1924 | Czarev et al. | 241/81 |
| 2,133,211 | 10/1938 | Schutte | 241/81 X |
| 4,288,038 | 9/1981 | Williams | 241/62 X |
| 4,339,085 | 7/1982 | Williams | 241/62 |
| 4,730,790 | 3/1988 | Williams | 241/81 |
| 5,074,435 | 12/1991 | Suverhrop et al. | 241/81 X |

FOREIGN PATENT DOCUMENTS

| | | | |
|---|---|---|---|
| 2636989 | 2/1978 | Germany . | |
| 3438310 | 4/1986 | Germany | 241/186.3 |
| 810630 | 3/1959 | United Kingdom | 241/62 |

*Primary Examiner*—Timothy V. Eley
*Attorney, Agent, or Firm*—Wells, St. John, Roberts, Gregory & Matkin

[57] ABSTRACT

A feeding device is disclosed for feeding cellulose material, such as wood chips to gas swept size reduction machines, and wherein the elimination of foreign particles from the material to be crushed is mainly achieved by pneumatic screening. The device includes a screening passage into which widely spread input material trickles slowly over a slide, having an angle of inclination β which is slightly greater than a friction-angle whose value is determined from its surface roughness. The screening passage is impacted by an air current generated by a cross current fan and which is directed, along a channel, roughly tangentially onto a guiding wall. The guiding wall is arranged at an angle of inclination γ, selected so that the guiding wall functions as a pneumatic sorting table, and where it forms with the channel a discharge slit for the foreign particles. The lateral spread of the input material is accomplished in the upper area of the feeding device by cascading surfaces which are arranged at an angle of inclination α, and which are covered with fine mesh screens to eliminate foreign particles of such a fine grain that they may not be effectively pneumatically screened.

10 Claims, 2 Drawing Sheets

FEEDING DEVICE FOR GAS SWEPT SIZED REDUCTION MACHINES

BACKGROUND OF THE INVENTION

The invention relates to a feeding device for air-flow-through crushing machines, also known as gas swept size reduction machines, which are used in particular to process materials consisting of cellulose such as precomminuted wood in the form of chips. Since such input material frequently originates from waste products, it can contain considerable amounts of foreign particles that may consist of metals, and also stones and sand. If such foreign particles enter the size reduction machines, they can cause considerable damage. This is especially the case with flaking machines, where the edges of the flaking knives are subject to rapid wear, if not damage. Furthermore, dull knives not only lessen the quality of the flakes produced but also cause a marked increase in power consumption during the flaking process which then results in frequent changes of the knives and all the costly inherent interruptions of production.

It has been known for a long time that, in order to reduce the damage and disadvantages caused by foreign particles, magnetically acting separation devices can be installed ahead of the intake of the size reduction machines. However, even if the magnetically acting separating devices function as intended they can remove only ferromagnetic foreign particles from the input material, while foreign particles made up of other substances such as stones, sand and soil remain unaffected.

In order to also remove non-ferrous foreign substances from the input material, it has been suggested in German application DE-OS 26 36 989, published February 1978, to install immediately ahead of the size reduction machine a separate feeding device in which an air current is used to separate the foreign particles. The air current produced by the paddle rotor of the size reduction machine, meets the input material as it is dropping inside a drop slide and carries the swirled material, largely by pneumatic action, into a central area of the paddle rotor. As part of this process, the foreign particles which are much more dense relative to the input process material should, as a result of their greater relative weight, pass across the sifting air current and in this way be eliminated from the process material. Whereas conventional feeding devices, functioning as pneumatic separators, have resulted in a certain reduction of damage and wear to the size reduction machines, it has become evident that larger particles of the process material are also disadvantageously eliminated contrary to intent, and smaller foreign particles still find their way into the size reduction machines.

SUMMARY OF THE INVENTION

An object of the invention is therefore to overcome the disadvantages of the prior art, that is, to remove all foreign particles as efficiently as possible, without the undesired removal of coarser process material at the same time.

In one of its aspects, the present invention resides in a feeding device for air-flow-through size reduction machines used in particular to process materials consisting of cellulose, such as precomminuted wood in the form of chips, with a paddle rotor inside a size reduction rim. The feeding device consisting of a drop slide which is alternately equipped with downward sloping cascading surfaces and which becomes at its lower end a roughly crosswise aligned feed duct which leads into the central area of the paddle rotor; an air intake channel leads into the rear section of the feed duct which, together with a roughly crosswise running and downward pointing discharge opening for eliminated foreign particles, forms a pneumatic sifting passage, characterized in such a manner that immediately ahead of the sifting passage a slide is located whose angle of inclination (β) is marginally greater than a frictional angle at which material thereon will remain in equilibrium, and that immediately after the sifting passage a pneumatic sorting table is arranged, inclined towards the direction of the air flow, so that it is somewhat tangentially impacted by the air intake channel, and that the respective widths of the feed duct, the slide, the sifting passage, the air intake channel and the pneumatic sorting table are nearly as wide as the inner diameter of the paddle rotor.

The applicant has discovered that where the input material glides into the sifting passage over a slide whose angle of inclination is only slightly greater than the frictional angle related to the roughness of its surface, the material particles trickle down this relatively rough slide at a greatly reduced speed. The result is that the material particles enter the sifting passage at extremely low speed and therefore stay in the sifting passage a correspondingly long time. This influences the pneumatic sorting process in the sifting passage advantageously insofar as the length the particles stay in the sifting passage is decisive for its effectiveness.

By the use of a pneumatic sorting table which adjoins directly to the sifting passage and which is inclined towards the direction of the air flow, so that it is somewhat tangentially impacted by the air intake channel, an additional elimination of foreign particles is achieved, which occurs by utilizing the boundary layer effect that occurs naturally on this sorting table, as will be explained in more detail later.

Providing uniform unit widths of feed duct, slide, sifting passage, air current intake, and the pneumatic sorting table corresponding closely to the inner diameter of the paddle rotor of the size reduction machine, creates a broad, widely spread, and therefore thin veil of input material, gradually trickling down, which is impacted from across by the sifting air current of the same width so that swirling of the input material and the resulting mutual hindrance are practically eliminated during the sifting process.

More preferably, the slide located immediately ahead of the sifting passage is formed by an upward slope of process material. The angle of inclination that determines the minimal entrance speed into the sifting passage adjusts itself in terms of the slope's angle, as a result of the inner friction within the heaped-up material.

Especially favourable air current conditions in the sifting passage and on the pneumatic sorting table occurs where the air intake channel is being fed by a cross current fan that extends axially over its entire width. Such a cross current fan delivers an equally distributed, turbulence-free air current over the entire width of the sifting passage and the sorting table.

The invention-based high degree of selection achieved in removing foreign particles from process material therefore rests essentially on the direct sequence of two pneumatic sorting stages that are optimally arranged and tuned to each other in terms of air current flow, that is, firstly, of the actual sifting passage and then of the directly adjoining sorting table inclined to the horizontal line.

Since there are natural limitations for very small foreign particles with the pneumatic sorting effect, as for example with sand,, additional measures functioning mechanically have been identified for their removal. For example, covering the cascading surfaces with mesh screens, and providing collection trays enables even extremely fine foreign particles to be remove from the process material.

BRIEF DESCRIPTION OF THE DRAWINGS

Further objects and advantages of the invention will appear from the accompanying drawings in which.

DETAILED DESCRIPTION OF THE INVENTION

Figure 1:
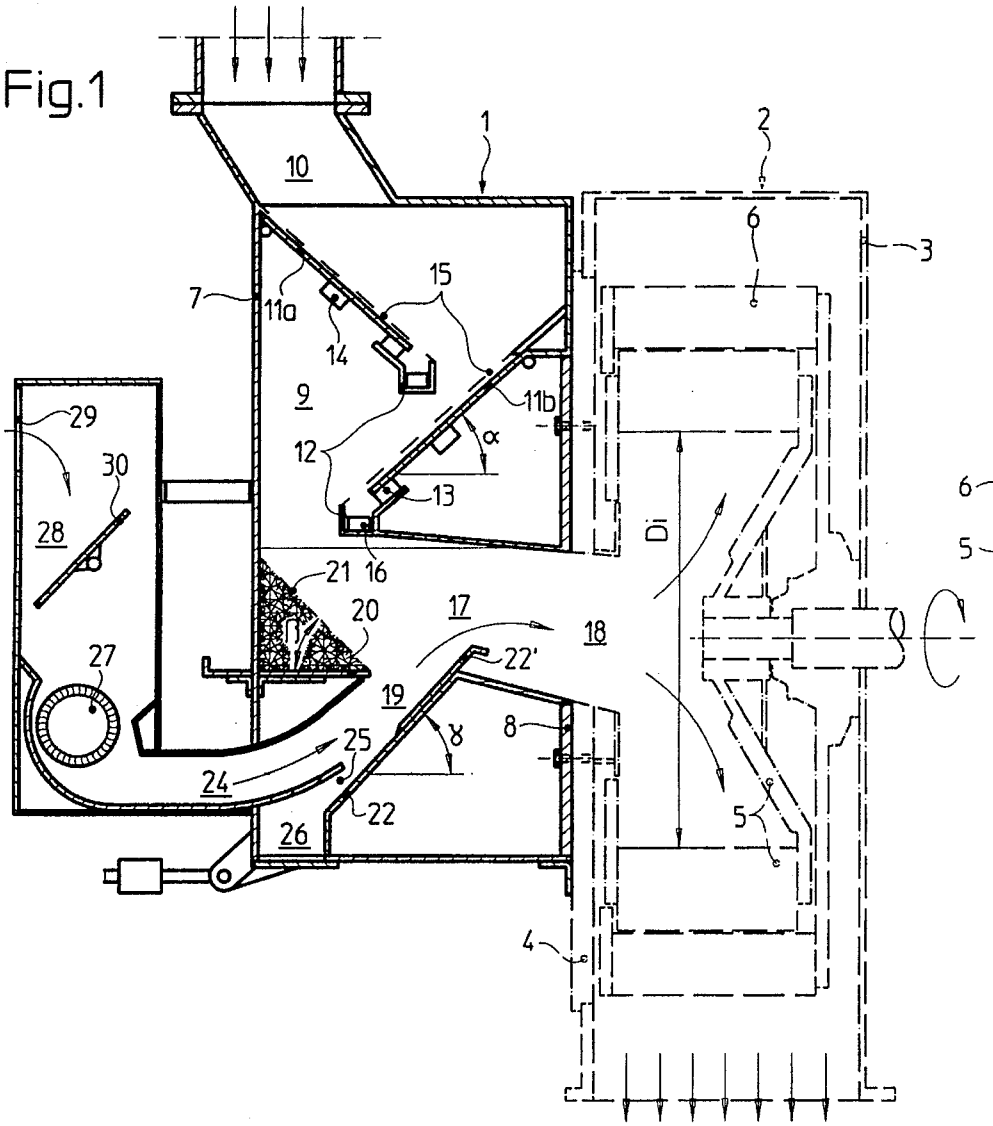
FIG. 1 is a schematic side view of a wood chipping machine incorporating a feeding device in accordance with the present invention, taken along line I—I in FIG. 2.

The feeding device 1 is attached directly to the front of a wood flaking machine 2. As shown schematically in the side view of FIG. 1 the chipping machine 2 includes a housing 3, which is accessible through an outward swivelling door 4. Inside the housing 3 a revolving paddle rotor 5 is mounted on bearings which is coaxially surrounded with little radial clearance by a knife rim 6 which contains the flaking knife blades (not shown).

The housing 7 of the feeding device 1 is attached at the door 4 by means of a support plate 8. The upper part of device 1 consists of a drop slide 9 into which the wood chips are fed via an input hopper 10. Inside the drop slide 9 which gets wider towards the bottom, two cascading surfaces 11*a*, 11*b* are arranged alternatively below one another, inclined at an angle $\alpha$. These sit at their lower ends on supporting cross members 12, along with interlaid elastic pads 13. The cascading surfaces 11*a*, 11*b* are equipped on their underside with vibrators 14 while their topsides are covered with screens 15, with a small gap in between, by means of which fine foreign particles such as sand are screened out from the wood chips as they slide over the tops of the screens. The supporting cross members 12 contain catch trays 16 for the screened-out fine particles; these can be pushed in and out from the side of the housing 7 of the feeding device 1 while the supporting cross members 12 serve as sliding tracks. The lower cascading surface 11*b* ends above a feed duct 17 which runs almost horizontally into the central area 18 of the paddle rotor 5.

Figure 2:
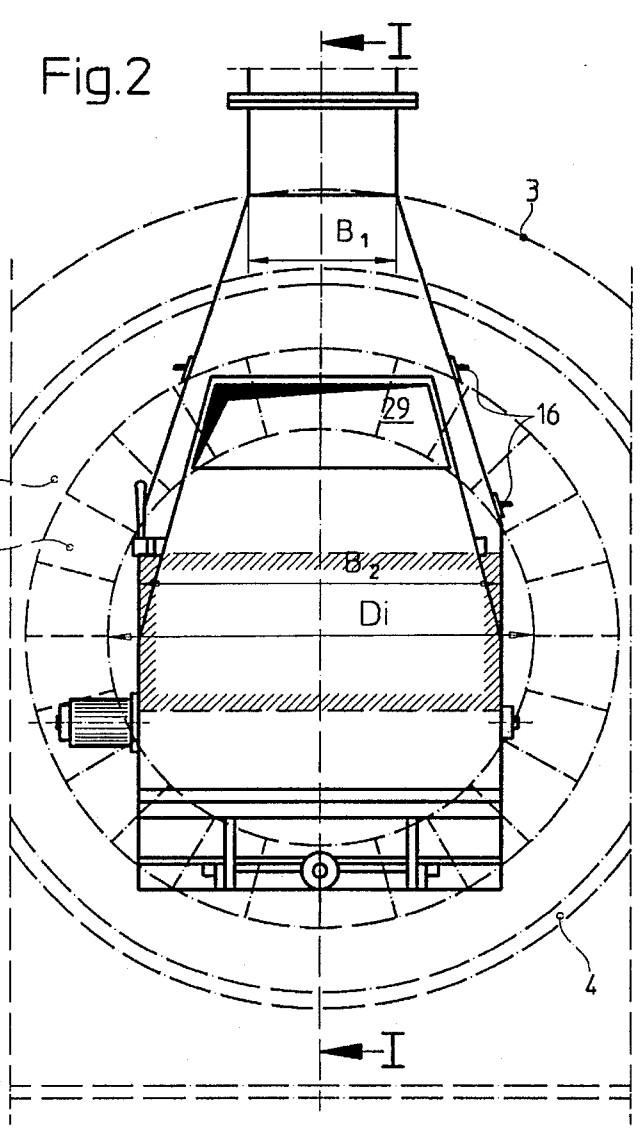
FIG. 2 is a schematic front view of the feeding device shown in FIG. 1.

The drop slide 9 and the cascading surfaces 11*a*, 11*b* that are arranged inside get wider toward the bottom, from width $B_1$ of the input hopper 10 to width $B_2$ of the feed duct 17, as can be seen from FIG. 2. The width $B_2$ is nearly as wide as the inside diameter $D_i$ of the paddle rotor 5.

In order to visualize these structural features, the cross section of the feed duct 17 has been highlighted by rectangular hatching in FIG. 2.

At the bottom end of the feed duct 17 is a pneumatic sifting passage 19 whose upper boundary is formed by an almost horizontally positioned supporting plate 20. On this the wood chips that fall down from the lower cascading surface 11*b* are heaped up to form an upward slope 21 with a natural slope angle $\beta$ that corresponds to the inner friction of the chip heap.

By shifting the supporting plate 20 horizontally the width W of the sifting passage 19 can be changed and with that, influence the sorting effect.

The lower boundary of the sifting passage 19 is formed by a guiding wall 22 which is inclined at an angle towards the horizontal; the guiding wall itself extends upwardly into the feed duct 17 and downwardly into a collecting channel 26 for eliminated foreign particles. An elongation plate 22' which is moveable into the feed duct 17 sits on the guiding wall 22.

The sifting air current flows through the screening passage 19; it comes from an air intake channel 24, which also has the width $B_2$ and which is pointed in a roughly tangential manner toward the guiding wall 22 at the angle of flow $\epsilon$, and with which it forms a discharge slit 25 for the foreign particles. The air intake channel 24 is being fed by a cross current fan 27 that extends axially across its entire width. Above the cross current fan 27, there is an air suction slide 28 which has an intake opening 29 at the top, opening into the front of the feeding device 1. For carefully monitoring the air current conditions inside the sorting area there is a throttle valve 30 provided within the air suction slide 28.

The feeding device 1, is preferably intended for a wood flaking machine 2 and shown as an implementation example of the invention, functions as follows: The wood chips are fed into the feeding device 1 via the input hopper 10 from where they slide down over the two cascading surfaces 11*a* and 11*b*. Since the cascading surfaces 11*a*, 11*b* become wider, from the width $B_1$ of the input hopper 10 on down to the width $B_2$ of the feed duct 17, the stream of input material moves generally equally toward both sides of the device 1 as it slides over the cascading surfaces 11*a*, 11*b*; this can still be enhanced by the action of the vibrators 14 and a sufficiently small angle of inclination $\alpha$.

If the cascading surfaces are additionally covered with screens 15, as is shown in the drawing, then the removal of tiny foreign particles, such as sand, soil, etc., will occur at the same time. These tiny foreign particles will be collected at the lower ends of the cascading surfaces 11*a*, *b* in catch trays 16 which are located inside supporting cross members 12, they are then emptied from time to time by pulling them out from the side of the housing 7 of the feeding device 1.

From the lower end of the second cascading surface 11*b* the wood chips drop, now evenly distributed across the width $B_2$ of the feed duct 17, onto the supporting plate 20 where they create a natural upward slope 21, on the surface of which they, together with the foreign particles, slowly trickle downward while slowing down constantly. Therefore, they enter with the minimal speed $v_e$ into the sifting passage 19 through which an air current flows that originates from the air intake channel 24. Since this air current is being generated by the cross current fan 27, it meets with its homogeneous, i.e. turbulence-free speed profile the veil of material that is slowly trickling down the slope 21 across the entire width $B_2$, as can be seen from FIG. 3. The wood chips, because of their low density and large air impact areas, are for the most part carried directly into the feed duct 17 by the largely turbulence-free sifting air current from where they immediately enter into the central area 18 of the paddle wheel 5. On the other hand, metallic particles, whose density can exceed that of wood chips by a factor of ten, will thereby certainly be eliminated from the chip material. This is true also for larger stones even though their density amounts to only about four times the density of the wood chips. Meanwhile the elimination of small pebbles and sand remains a problem, as is demonstrated in FIG. 3.

Since the form of a grain of sand and that of small pebbles approaches the shape of a sphere, their behaviour in the air current of the screening passage 19 lends itself readily to theoretical study. Assuming that the chip material, including foreign particles, trickle into the screening passage whose width W is assumed to be 0.1 m with an entrance velocity of $v_e$=0.5 m/s, and with the mean air speed to be $\overline{W}_L$=10 m/s, the drift deviations $s_1$ to $s_5$ can be quite accurately calculated, i.e. the drift deviations that the grains of sand experience in the sifting passage on their way to the opposite guiding wall 22, assuming they have spherical shape. In this case the index numbers 1 to 5 relate to the corresponding diameter $d_k$ (mm) of the grains of sand. Based on the drift deviations s, a course of movement shown in FIG. 3 can be conjectured, which the sifting air current is imposing on the grains of sand in the sifting passage 19.

Figure 3:
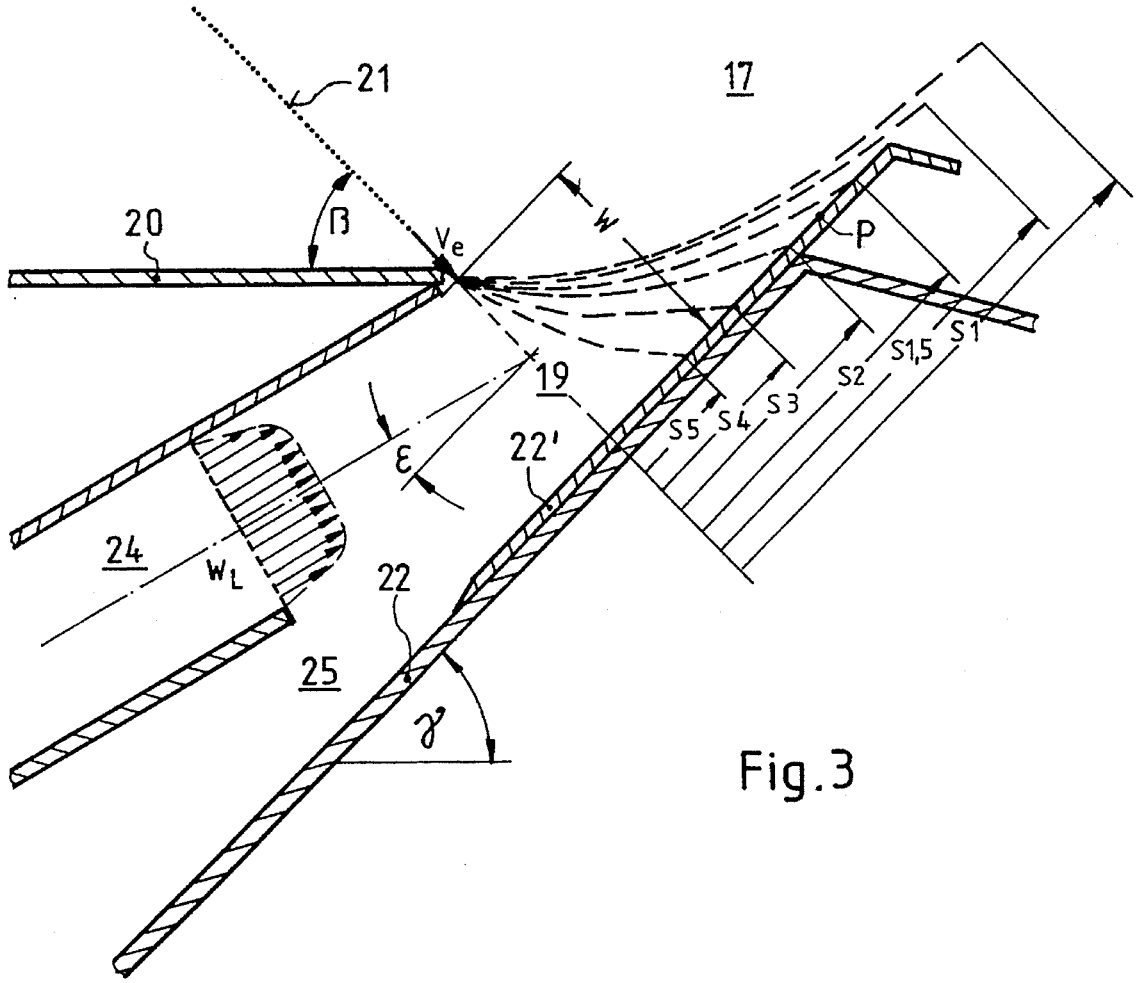
FIG. 3 is a schematic illustration of the sifting passage and the pneumatic sorting table of FIG. 1 in an enlarged scale.

It can be seen from the drift deviations s entered in FIG. 3, that those grains of sand whose diameter is $d_k$<2 mm do not even get as far as to the guiding wall 22, but are carried immediately by the sifting air current into the feed duct 17 and thus into the chipping machine 2. By shifting the elongation plate 22' the size of the grains of sand carried along can be somewhat influenced, however, there are also natural limitations to this method. Thus, it can be assumed that it is practically unavoidable for small grains of sand under 1 mm to be carried along by the sifting air current.

Since in the described case the sifting air current hits the guiding wall 22 below the angle $\epsilon$=15°, larger grains of sand ($d_k$>1 mm) that did get to the guide wall 22 after having passed through the sifting air current are even here still subjected to the influence of the sifting air current. This situation is schematically shown on a larger scale in FIG. 4:

A grain of sand with a diameter $d_k$ on the guiding wall 22, 22' inclined at an angle $\gamma$=45° to the horizontal and functioning as a pneumatic sorting table 23, is subjected, on the one hand, to the downward driving force $F_A$ and, on the other hand, to the pneumatic sweeping force $F_S$ acting in the opposite direction.

If both forces are equal then the grain of sand, assumed to be of spherical shape, will be kept in suspension on the sorting table 23. By equalizing the conditional equations for both forces $F_A$ and $F_S$, the critical air speed $W_{LKr}$ can then be calculated at which the grain of sand is kept in an exact state of equilibrium. Thus the following values for the critical air speed $W_{LKr}$, are arrived at for grains of sand of variable size $d_K$:

| dk | (mm) | 1 | 1.5 | 2 | 3 | 4 | 5 |
|---|---|---|---|---|---|---|---|
| $w_{Lkr}$ | (m/s) | 6.9 | 8.5 | 9.7 | 12 | 13.8 | 15.5 |

Figure 4:
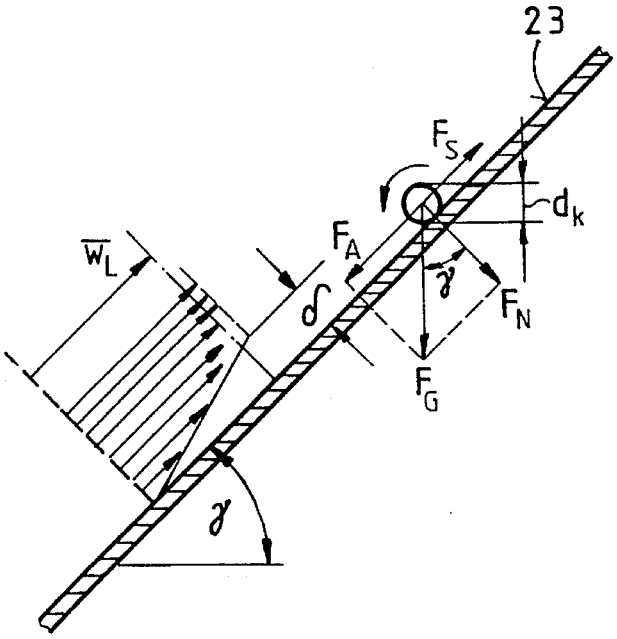
FIG. 4 shows a graphic illustration of the movement of a foreign particle on the pneumatic sorting table of the present invention in an enlarged scale.

Since in the described case the mean air speed $\overline{W}_L$ has been assumed to be 10 m/s, all the grains of sand that require an air speed $w_L$<10 m/s in order to be kept in a state of suspension, i.e., here $d_k$= 1, 1.5, and 2 mm, should accordingly be blown from the sorting table 23 in the direction of the feed duct 17. However, as illustrated in FIG. 4, this is not the case because on the sorting table 23 a boundary layer of thickness $\delta$ is formed which amounts to about 2.5 mm, based on the assumed air flow conditions and the boundary layer theory. Because the air speed in the boundary layer $\delta$ drops sharply towards the wall, significantly lower air speeds relative to the mean air speed $\overline{W}_L$ exist there, so that grains of sand that have a $d_k$<2 mm remain practically unaffected by the air current, since the sweeping force $F_S$ that acts upon them is considerably smaller than their downward driving force $F_A$ causing them to roll down unhindered into the collecting channel 26. Since this favourable effect which the boundary layer has on the elimination of grains of sand becomes more pronounced as the grains of sand get smaller it can be assumed that all grains of sand, as long as they have reached the sorting plane 23 after having passed the sifting air current, will at that point be eliminated without any impact by the air current.

Not only foreign particles but also larger wood chips can reach the sorting table 23 which is inclined to the horizontal line. For a generally rectangular prismatic chip whose dimensions are 5×2×1.5 cm edge to edge a rough calculation has resulted in the point of impact P which is entered in FIG. 3. To arrive at a state of equilibrium for this chip on the sorting table 23 a critical air speed of about 7 m/s would be required.

Since here, as a result of the large chip dimensions, the boundary layer effect cannot work this chip will be impacted by the full air speed $w_L$=10 m/s, so that it will be carried along by the air current blowing over the sorting table 23 and into the chipping machine. Based on these theoretical studies it can therefore be assumed that all chips, as long as they are not extremely large wooden pieces, will in every case be carried along by the screening air current and will consequently land inside the flaking machine 2, as desired.

However, when fine sand ($d_k$<2 mm) passes the sifting screening air current, it cannot reach the sorting table 23 at all, as seen in FIG. 3, but will already beforehand be swept along into the chipping machine. There it causes, because of the sand blasting effect, not only severe erosion of the knife edges, but furthermore gets into the end products which are manufactured from the flake material produced, for example, particle board, where it causes rapid wear of the tools upon their further processing. Therefore, both of these extremely negative effects of fine sand are calling for its elimination from the chip material too, something that can, however, be accomplished only by mechanical means, and something that has to occur already before the pneumatic sorting. To this end, the cascading surfaces 11*a*, 11*b* are covered with the screens 15, whose mesh width should not exceed 2.5 mm, based on the air current conditions assumed in the case described.

The usability of the feed device, which is constructed in accordance with the invention, is in no way restricted to size reduction machines; it can also be used with other industrial process machines and devices, as long as there, too, the problem exists to eliminate foreign particles from the process material as completely as possible.

Although the disclosure describes and illustrates preferred embodiments of the invention, it is not limited to these particular embodiments. Many variations and modifications will now occur to those skilled in the art. For a definition of the invention reference is made to the appended claims.

I claim:

1. In combination, a feeding device and a gas swept size reduction machine used to process materials consisting of cellulose with a paddle rotor inside a size reducing rim, the feeding device including a drop slide which is equipped with alternately downward sloping cascading surfaces and which becomes at a lower end a roughly crosswise aligned feed duct which leads into a central area of the paddle rotor; an air intake channel which leads into a rear section of the feed duct, and a roughly crosswise running and downward pointing discharge opening for eliminated foreign particles, the air intake channel and discharge opening forming a pneumatic sifting passage, characterized in such a manner that immediately ahead of the sifting passage a slide is located having an angle of inclination marginally greater than a frictional angle at which material thereon will remain in equilibrium, and that immediately after the sifting passage a pneumatic sorting table is arranged, ascending in the direction of the air flow, so that it is tangentially impacted by air from the air intake channel, and that the respective widths of the feed duct, the slide, the sifting; passage, the air intake channel and the pneumatic sorting table are nearly as wide as an inner diameter of the paddle rotor.

2. The combination in accordance with claim 1, further including a heap of said process material to be crushed, the slide comprising an upward slope of said heap of process material whose slope angle depends on the inner friction of the process material.

3. The combination in accordance with claim 2, characterized in such a manner that an upper boundary of the sifting passage forms a supporting plate which also serves to support the heap of process material, and that the sifting passage is delineated on a lower opposite side by an ascending guiding wall which forms the pneumatic sorting table; the guiding wall extending upwardly beyond the sifting passage to the feed duct and downwardly to a collecting channel for the eliminated foreign particles, the guiding wall forming the discharge opening for the foreign particles at a point of convergence with the air intake channel.

4. The combination in accordance with claim 3, characterized in such a manner that the angle of ascent of the guiding wall lies between 40° and 50°, and that the air intake channel forms an air intake angle with the guiding wall of between 0° and 30°.

5. The combination in accordance with claim 2, characterized in such a manner that the supporting plate for the heap of process material is horizontally adjustable, and that an elongation plate is provided on the guiding wall and is extensible into the feed duct.

6. The combination in accordance with claim 1, characterized in such a manner that the air intake channel is fed by a cross current fan that extends axially over its entire width.

7. The combination in accordance with claim 1, including an input hopper for feeding said material to an upper end of the drop slide the cascading surfaces becoming continually wider from a width of the input hopper at a upper end of the, drop slide, to a width of the feed duct at the lower end of the drop slide, and the cascading surfaces supported on supporting cross members including interlaid elastic pads, the device further including vibrators for vibrating the cascading surfaces.

8. The combination in accordance with claim 1, wherein the cascading surfaces are covered with screens whose mesh width is selected to permit movement of a borderline grain size of a foreign particle that cannot be eliminated pneumatically therethrough.

9. The combination in accordance with claim 8, characterized in such a manner that collecting trays for collecting particles which pass through the screens are provided at the lower end of the cascading surfaces.

10. The combination in accordance with claim 9, further including cross members for supporting the cascading surfaces and collection trays, the cross members serving as sliding tracks permitting the collecting trays to be pulled out from the device.

* * * * *